US007114311B2

(12) United States Patent
Drolet

(10) Patent No.: US 7,114,311 B2
(45) **Date of Patent: *Oct. 3, 2006**

(54) METHOD AND APPARATUS FOR AUTOMATED WRAPPING

(75) Inventor: Sylvain Drolet, Fabreville (CA)

(73) Assignee: Marko I.R.D.C. Inc., St-Leonard (CA)

( * ) Notice: Subject to any disclaimer, the term of this patent is extended or adjusted under 35 U.S.C. 154(b) by 73 days.

This patent is subject to a terminal disclaimer.

(21) Appl. No.: 11/149,429

(22) Filed: Jun. 10, 2005

(65) Prior Publication Data

US 2005/0274089 A1 Dec. 15, 2005

Related U.S. Application Data

(60) Continuation of application No. 10/968,096, filed on Oct. 20, 2004, now Pat. No. 6,978,587, which is a division of application No. 10/204,441, filed on Sep. 3, 2002, now Pat. No. 6,904,736.

(51) Int. Cl.
*B65B 53/00* (2006.01)

(52) U.S. Cl. ..... 53/441; 53/459; 53/456

(58) Field of Classification Search ..... 53/556, 53/564, 567, 575, 441, 457, 459, 456
See application file for complete search history.

(56) References Cited

U.S. PATENT DOCUMENTS 3,809,223 A 5/1974 Kendall 6,161,365 A 12/2000 Girard et al.

FOREIGN PATENT DOCUMENTS

| | | |
|---|---|---|
| CA | 2198201 | 2/1997 |
| CA | 2230026 | 2/1998 |
| CA | 2240062 | 7/1998 |
| CA | 2277565 | 10/2004 |
| DE | 27 06 955 | 8/1979 |
| WO | WO 95/02538 | 1/1995 |

*Primary Examiner*—Rinaldi I. Rada
*Assistant Examiner*—John Paradiso
(74) *Attorney, Agent, or Firm*—Ogilvy Renault LLP

(57) ABSTRACT

A method and apparatus are provided for the automated wrapping of a bundle with a resilient stretchable film. The method comprises the steps of (i) unrolling a desired length of the film from a roll. The film has a first panel overlapping a second panel. The panels are interconnected at a sealed first end. (ii) Sealing a second end of the panels to bond them together by a second seal at the desired length. (iii) Cutting the film along the second seal to form a tube. (iv) Separating the first panel of the tube from the second panel by grasping film edges of each of the panels, whereby the tube may be opened. (v) Loading the tube in an opened position on an expandable frame, whereby at least a portion of the tube is accumulated in a folded condition on the expandable frame. (vi) Stretching the tube by expanding the expandable frame. (vii) Covering the bundle with the tube, by displacing the expandable frame towards the bundle, whereby the stretched tube is gradually released therefrom onto the bundle in a stretched resilient condition.

4 Claims, 5 Drawing Sheets

1
2
3
4

METHOD AND APPARATUS FOR AUTOMATED WRAPPING

CROSS-REFERENCE TO RELATED APPLICATIONS

This application is a continuation of U.S. patent application Ser. No. 10/968,096 filed on Oct. 20, 2004, now U.S. Pat. No. 6,978,587, which is a divisional of U.S. patent application Ser. No. 10/204,441, filed on Sept. 3, 2002, now U.S. Pat. Ser. No. 6,904,736.

The present application claims priority on International Patent Application No. PCT/CA01/00264, filed on Mar. 1, 2001, and on U.S. Provisional Patent Application No. 60/186,740, filed on Mar. 3, 2000.

FIELD OF THE INVENTION

The present invention relates to a method and an apparatus for automated wrapping of bundles and, more particularly, for the automated wrapping of generally rectangular bundles of varying size on four or five faces thereof.

BACKGROUND OF THE INVENTION

The products of the forest industry, e.g. lumber pieces, are customarily stored outdoors in piles for subsequent transportation. To keep lumber pieces relatively dry, bundles of lumber pieces are customarily covered to be. protected from weathering. In order for some of the lumber inherent humidity to evaporate, bundles are often covered on five surfaces, leaving the bottom surface uncovered, whereby condensation may escape. Bundles have also been covered on their four lateral side faces, thereby leaving the bottom and top surface open, such that further humidity may escape. This latter four-face wrapping configuration is used with bundles placed under a roof and is also used to bond bundles of lighter material together, such as pallets of plastic components.

U.S. Pat. No. 3,809,223, issued on May 7, 1974 to Kendall discloses a five-face wrapping method wherein a inverted bag of heat shrinkable film is disposed on a bundle and is heated to tightly bond with the bundle. A moisture absorbent layer is disposed between the top surface of the bundle and the heat shrinkable film, whereby excess humidity is absorbed.

Canadian Patent Applications No. 2,198,201 and No. 2,230,026, both having a priority date of Feb. 21, 1997 disclose a frame having an expandable throat portion through which bundles pass while being displaced on a conveyor. A plastic tube having a closed end is disposed on the throat portion of the frame with the closed end placed downstream with respect to the conveyor such as to cover the opening defined by the throat portion. The tube portion is generally folded in accordion on the throat portion, which is expanded to stretch the plastic tube It is noted that the plastic tube consist of a plastic film stretchable and resilient at room temperature. As the bundle passes through the throat portion, the closed end of the plastic tube is caught by the front end of the bundle. As the bundle advances, the tube is gradually released from the throat portion, thereby tightly bonding to the bundle as it resiliently regains its shape. Once the bundle is downstream of the throat portion, a cutting and sealing apparatus cuts and seals the open end of the tube, thereby fully enclosing the bundle therein. It is noted that a corresponding Application has been awarded a patent, namely U.S. Pat. No. 6,161,365, issued on Dec. 19, 2000, to Girard et al. and discloses the method described above for hermetically bagging material such as lumber pieces. It is also observed that the step of disposing the plastic tube on the frame involves manual intervention.

Canadian Patent Applications No. 2,240,062 and No. 2,277,565 disclose a wrapping machine and a related method, which describe moveable arms which hold opposed ends of a plastic film. The arms are pivotally mounted in order to fold the plastic film on the four lateral side surfaces and the top surface of a bundle, thereby leaving the bottom surface uncovered. Each arm also comprises a stapling mechanism for securing the film to the bundle. These patent applications are fully automated.

The use of resilient plastic film is advantageous as it ensures a tight bonding with the bundled items. Heat shrinkable film provides a similar tight bonding, but involves heating means and is thus not as convenient and more costly. It appears that packaging with resilient plastic film provides a cost efficient method and desirable results. Thus, it would be desirable to apply these polymer properties with four or five face wrapping of bundles.

SUMMARY OF THE INVENTION

It is a feature of the present invention to provide a fully automated wrapping apparatus using stretchable plastic film for wrapping bundles on at least four faces.

It is a further feature of the present invention to provide a fully automated method for dispensing bags from storing position to wrap bundles.

According to the above features of the present invention, from a broad aspect, there is provided a method for automated wrapping of a bundle with a resilient stretchable film. The method comprises the steps of:

(i) unrolling a desired length of the film from a roll, the film having a first panel overlapping a second panel, the panels being interconnected at a sealed first end;

(ii) sealing a second end of the panels to bond them together by a second seal at the desired length;

(iii) cutting the film along the second seal to form a tube;

(iv) separating the first panel of the tube from the second panel by grasping film edges of each the panels, whereby the tube may be opened;

(v) loading the tube in an opened position on an expandable frame, whereby at least a portion of the tube is accumulated in a folded condition on the expandable frame;

(vi) stretching the tube by expanding the expandable frame; and (vii) covering the bundle with the tube, by displacing the expandable frame towards the bundle, whereby the stretched tube is gradually released therefrom onto the bundle in a stretched resilient condition.

According to a further broad aspect of the present invention, there is provided an apparatus for automated wrapping of a bundle. The apparatus comprises a table having a top surface. A dispensing roll of resilient stretchable film is adjacent a first end of the table. Gripping means translate on the top surface of the table for pulling the film from the dispensing roll to an extended position, wherein a desired length of the film is disposed on the table. Sealing and cutting means at the first end of the table are provided for sealing and cutting the film in the extended position from the dispensing roll, whereby the film forms a collapsed tube. At least first and second jaw means grasp corresponding side edges of the collapsed tube in the extended position and displace them apart, whereby the tube is in an opened position. The first and second jaw means dispose the tube on an expandable frame. Winding means on the expandable frame pull the tube from the opened position to an accumulated condition, wherein at least a portion of the tube is accumulated in folds around the expandable frame. Means are provided to displace the expandable frame to a film expanding position stretch the tube in the accumulated condition. Means are provided to move the expandable frame towards the bundle whereby an upper portion of the tube covers the bundle and the tube is gradually released thereon in a stretched resilient condition to generally cover at least four faces of the bundles.

BRIEF DESCRIPTION OF THE DRAWINGS

A preferred embodiment of the present invention will now be described in detail having reference to the accompanying drawings in which.

DESCRIPTION OF PREFERRED EMBODIMENTS

Figure 1:
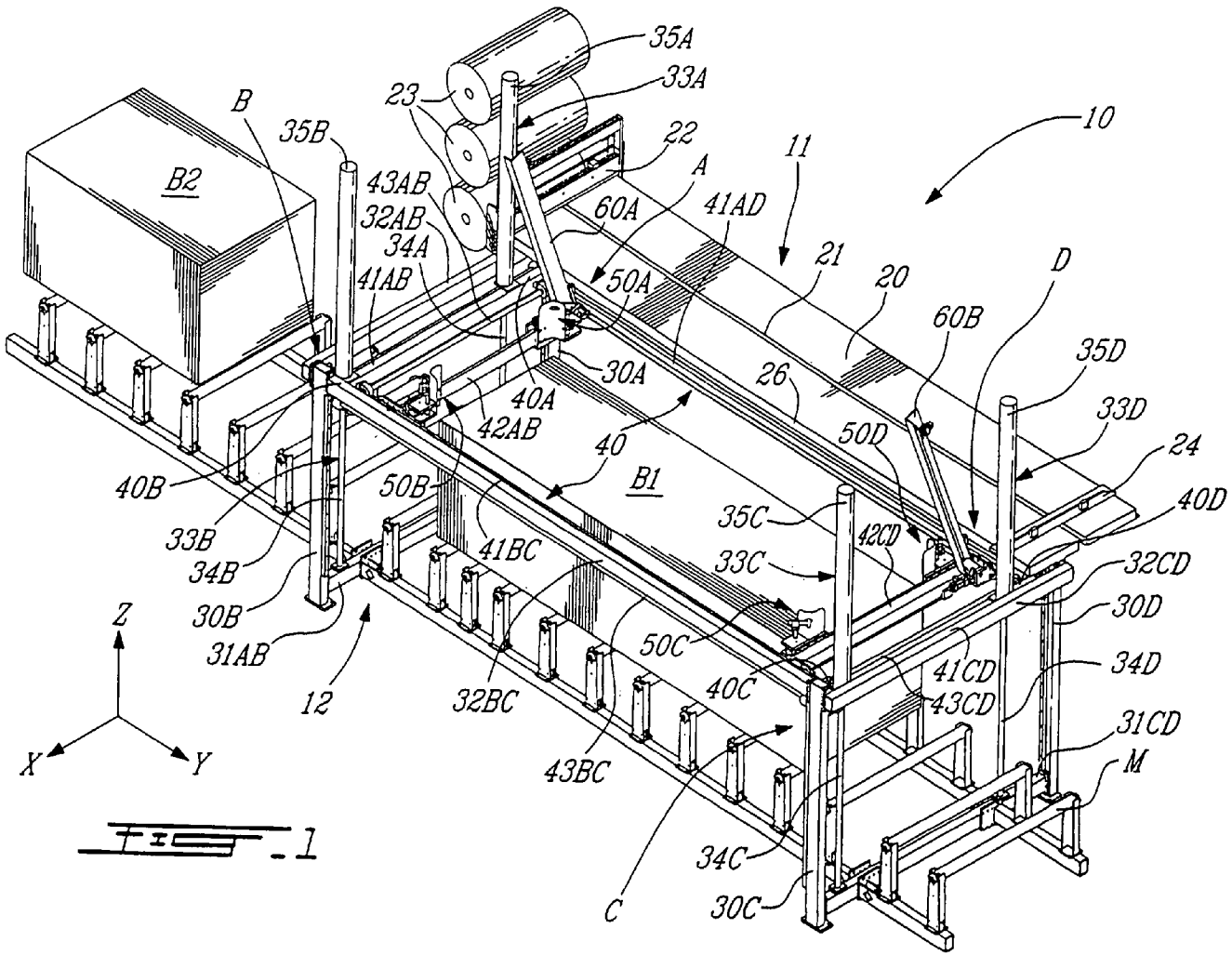
FIG. 1 is a perspective view of the automated wrapping apparatus in accordance with the present invention.
Figure 4:
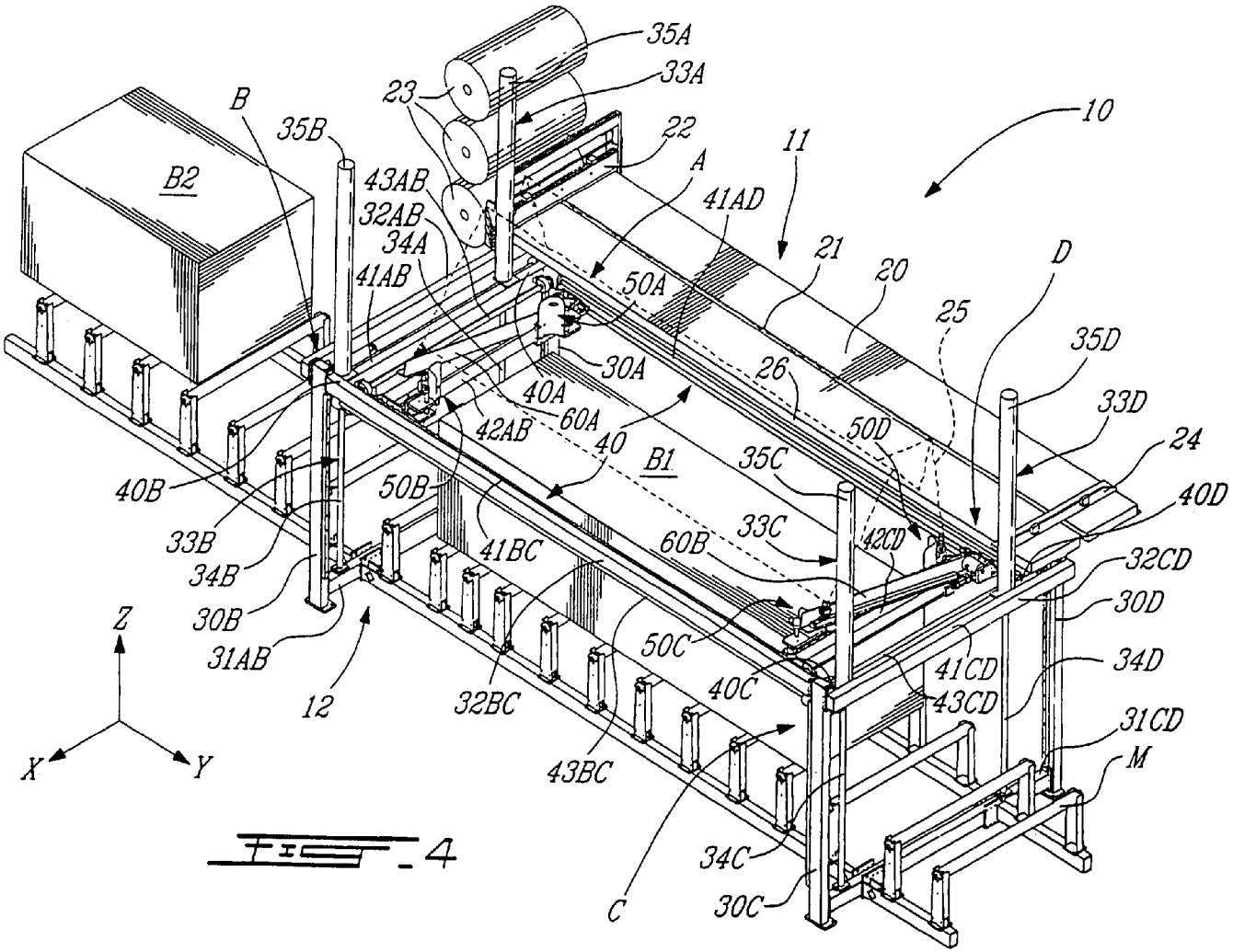
FIG. 4 is a further perspective view of the automated wrapping apparatus.
Figure 5:
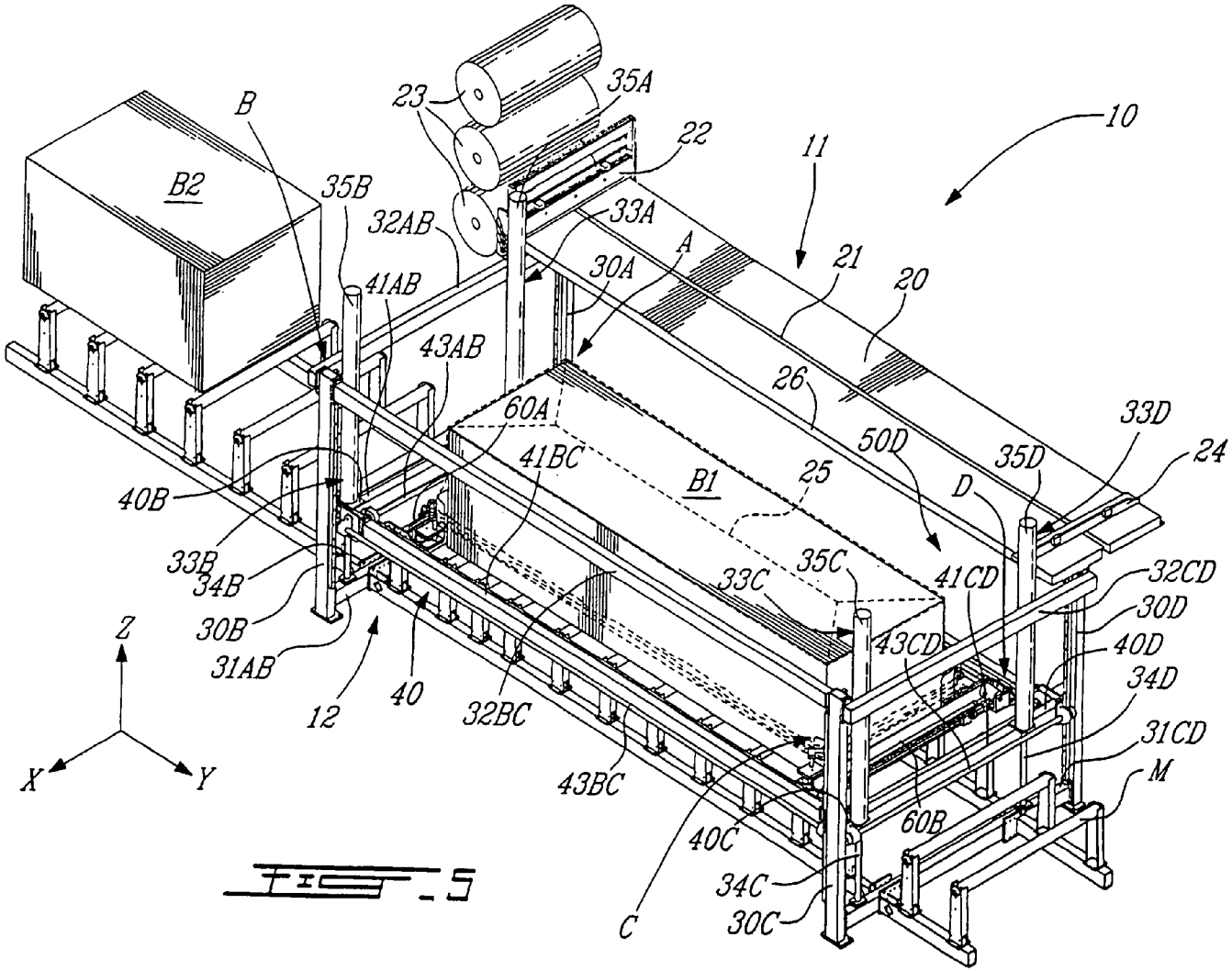
FIG. 5 is a still further perspective view of the automated wrapping apparatus.

According to the drawings and more particularly to FIGS. 1, 4 and 5 an automated wrapping apparatus in accordance with the present invention is generally shown at 10. For reference purposes, a set of X-Y-Z axes has been added to the perspective views of the automated wrapping apparatus. The automated wrapping apparatus 10 comprises a dispensing apparatus 11 and a stretching apparatus 12, and spans over a motorized conveyor M upon which bundles B1 and B2 are displaced in the positive direction of the Y-axis. The bundle B1 is illustrated in position to be wrapped on its four lateral faces and, if desired, on its top surface. As explained hereinafter, a specifically sized bag or tube will be dispensed, sealed and cut in the dispensing apparatus 11, and will be opened, stretched and wrapped upon the bundle B1 in the stretching apparatus 12. Thereafter, the motorized conveyor M will be activated to move the wrapped bundle B1 downstream of the automated wrapping apparatus 10, while the bundle B2 will be positioned to be wrapped. It is pointed out that the conveyor M may be positioned with respect to the automated wrapping apparatus 10 such that the bundles are fed thereto from either one of the negative Y-axis direction, the positive and the negative X-axis directions.

Referring in particular to FIG. 1, the dispensing apparatus 11 has a table 20 with a longitudinal channel 21 generally in the middle thereof. A pulling arm 24 is slidably disposed on the table 20, and is engaged in the channel 21, whereby it translates longitudinally upon the table 20, i.e. in the Y-axis direction. The channel 21 may enclose a linear actuator, a rodless cylinder or the like in order to displace the pulling arm 24 and position it precisely upon the table 20. The pulling arm 24 is also provided with an actuated gripping member (not shown).

A sealing and cutting device 22 is secured at a first end of the table 20. A plurality of rolls of film 23 are disposed adjacent the first end of the table 20 in a dispensing position, whereby free ends of either one of the film rolls 23 are grasped by the actuated gripping member of the pulling arm 24 and pulled through the sealing and cutting device 22. The pulling arm is stopped when a desired length of film has been pulled on the table 20, according to the size of the bundles to be wrapped. Once the desired length of film is pulled on the table by the pulling arm 24, it is sealed and cut by the sealing and cutting device 22. The sealing and cutting device 22 is a known mechanism which applies heat to the film to create a sealed seam, and cuts the sealed seam such that both sides of the cut are sealed. Accordingly, both ends of the film that has been pulled by the pulling arm 24 will be sealed, namely the end engaged in the gripping member of the pulling arm 24 and the end that has been sealed and cut, whereby a tube or a bag is formed, as will be described below.

Figures 2A, 2B, 2C, 2D, 2E, 2F:
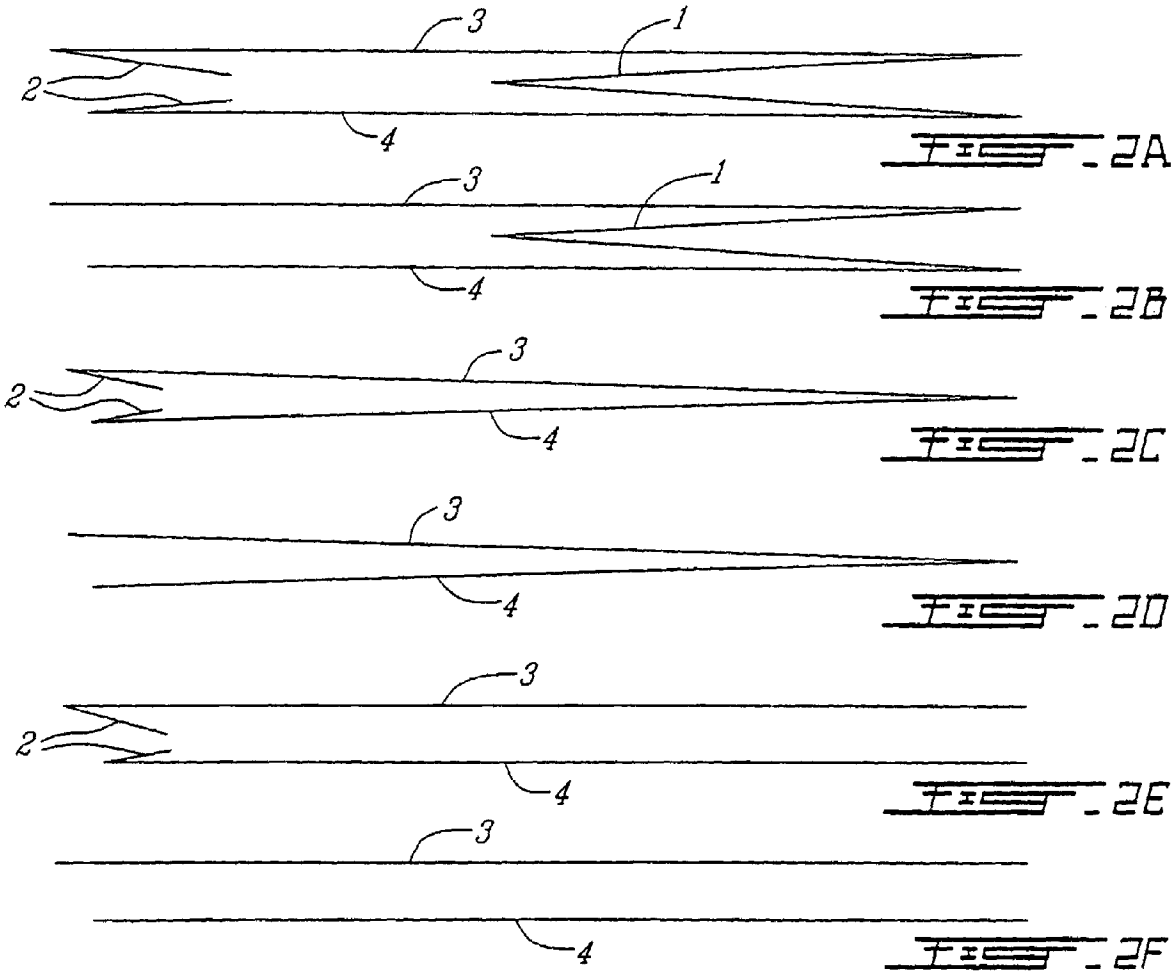
FIG. 2 is a cross sectional view of film configurations to be used with the automated wrapping apparatus of the present invention.

Referring now to FIGS. 2A to 2F, cross sections of various rolls of pre-folded film to be used with the automated wrapping apparatus 10 are shown. The material of the film consists of known low density polymers which is stretchable and resilient at ambient temperature. FIGS. 2A to 2D illustrate plastic films which that will be formed in bags which will be inverted for covering the lateral faces and the top surface of the bundle, i.e. five-face wrapping, whereas FIGS. 2E and 2F depict films that will be formed in tubes for covering the lateral surface thereof, i.e. four-face wrapping. Each cross-section shows a top portion 3 and a bottom portion 4. FIGS. 2A and 2B illustrate plastic films having a gusset 1. The gusset 1, when the bag covers the bundle, corresponds to the top surface thereof. The gusset 1 ensures that the bag will embrace the shape of the bundle. FIGS. 2C and 2D do not have a gusset, and thus the bag made therewith will have protruding ears emerging from two of the four edges of the top surface of the bundle. Furthermore, FIGS. 2A, 2C and 2E each show slits 2. The slits 2 will cover a portion of the bottom surface of the bundle when the bag or tube will be engaged thereon. It is observed that the upper portion 3 of the bag/tube is in each case longer than the bottom portion 4 of bag/tube.

Figure 3:
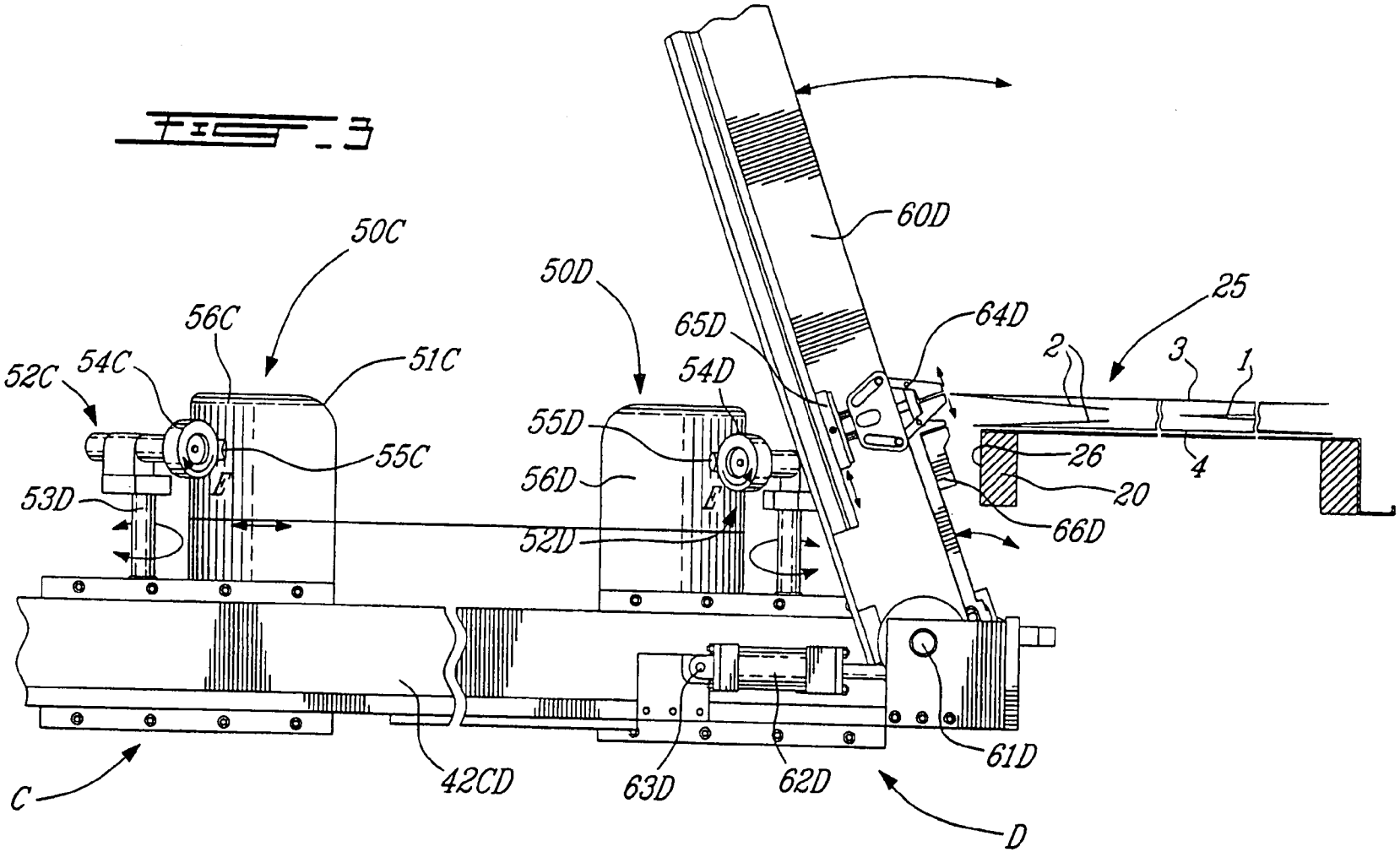
FIG. 3 is an enlarged fragmented view of film handling assemblies in accordance with the present invention.

Referring now to FIG. 3, a length of film that has been pulled by the pulling arm 24 on the table 20 is generally shown in a cross-sectional view at 25. It is noted that the film used in FIG. 3 is the type depicted in FIG. 2A. It is also noted that the free ends of the pulled film 25 extend over an edge surface 26 of the table 20. The edge 26 of the table is adjacent the stretching apparatus 12.

Returning now to FIG. 1, the stretching apparatus 12 of the automated wrapping apparatus 10 has a fixed structure comprising four vertical uprights 30A, 30B, 30C and 30D. A bottom transverse member 31AB is secured to bottom ends of the vertical uprights 30A and 30B. For the clarity of the description, letters affixed to numbers such as vertical upright 30A will designate a determined corner of the stretching apparatus 12. Furthermore, transverse members extending from a corner to another will be affixed with the letters corresponding to both corners, for instance bottom transverse member 31AB. Thus, a bottom transverse member 31CD is located at an opposed side of the stretching apparatus 12. Upper transverse members 32 connect the four vertical uprights 30A to 30D and are thus designated by 32AB, 32BC, 32CD, 32AD. However, the transverse member 32AD is below the table 20 and is thus not shown.

Referring to FIGS. 1, 4 and 5, cylinders 33A to 33D are located at each corner of the stretching apparatus 12. Rods 34A to 34D of the cylinders 33A to 33D are fixedly secured to the bottom transverse members 31AB and 31CD, at the corresponding corners. Housing portions 35A to 35D of the cylinders 33A to 33D, respectively, are moveable and may thus translate up and down on the rods 34, i.e. in the Z-axis direction. A moveable frame 40 of rectangular shape is secured at its four corners 40A, 40B, 40C and 40D to the corresponding housing portions 35A to 35D. Consequently, the moveable frame 40 can move upward and downward, i.e. in the Z-axis direction, with respect to the vertical uprights 30A to 30D, when actuated by the cylinders 33A to 33D, respectively. The moveable frame consists of four channels, 41AB, 41BC, 41CD and 41AD. The channels 41BC and 41AD are C-cross sectioned and face each other, whereby guides 42AB and 42CD are disposed therein.

Also shown are rollers 43AB, 43BC, 43CD and 43AD secured to the moveable frame 40, which are each idle and free to rotate, and wheels at opposed ends rotatively engaged in the vertical uprights 30A to 30D. The rollers ensure the smooth upward and downward translation of the moveable frame 40 upon the vertical uprights 30A to 30D when actuated by the cylinders 33A to 33D.

The guide 42AB is fixed to the channels 41AD and 41BC, whereas the guide 42CD is moveably engaged therein using known methods. Consequently, the guide 42CD can translate in the Y-axis direction, which corresponds to the longitudinal direction of the bundle B1.

Film handling assemblies 50A to 50D are disposed on the guides 42AB and 42CD at the corresponding corners A to D. Referring to FIG. 3, the film handling assemblies 50C and 50D are shown in an enlarged view. For simplicity purposes, the film assembly 50D will be described in detail. Thereafter, like numerals with varying affixed letter thereto will designate like elements. The film handling assembly 50D has a bracket 51D and a winder 52D. The bracket 51D forms an arcuate wall having a rear surface 56D and a bearing surface 55D idle and free to rotate therein. The winder 52D is pivotally mounted to the film handling assembly 50D by a pivot 53D upon which a friction wheel 54D is motorized, whereby the friction wheel 54D may be actuated to pivot about the pivot 53D to come into contact with the bearing surface 55D. When the friction wheel 54D is actuated to rotate, the bearing surface 55D rotates therewith, in an opposed direction, as they are in operative contact. This is likewise for film handling assemblies 50A to 50C.

Returning now to FIG. 1, the film handling assemblies 50B and 50C may translate on the guides 42AB and 42CD, respectively. Accordingly, they may be motorized and/or electrically driven using known mechanisms to translate thereon. It is thus noted that the film handling assembly 50A is fixed about the moveable frame 40. The film handling assembly 50B can translate on the guide 42AB as described above, i.e. in the X-axis direction with respect to the moveable frame 40. Furthermore, the film handling assembly 50D can translate in the Y-axis direction with respect to the moveable frame 40 as the guide 42CD is displaceable thereabout, as explained herein before. Finally, the film handling assembly 50C may translate in both the X-axis and the Y-axis direction. In a preferred embodiment, the film handling assemblies 50B, 50C and 50D are actuated by hydraulic cylinders as relatively substantial force will be required to stretch the bag or tube thereon as will be explained hereinafter.

A film opening arm 60A is pivotally disposed at a free end thereof to the guide 42AB. Similarly, a film opening arm 60D is pivotally disposed at an end of the guide 42CD at the corner D, as well seen in FIG. 3. The film opening arms 60A and 60D are symmetrically identical. Thus, for clarity, the film opening arm 60D will be described in detail by referring to FIG. 3, and thereafter, reference to like numerals with an A affixed thereto, for instance in the drawings, will designate like elements of the film opening arm 60A. The film opening arm 60D is pivotally fixed to the guide 42CD at pivot point 61D. A cylinder 62D, pivotally fixed at point 63D, actuates the movement of the film opening arm 60D to pivot it about the pivot point 61D. The cylinder may be hydraulically, pneumatically or electrically driven. A first jaw 64D is disposed on a carriage 65D. The carriage 65D can translate up and down the film opening arm 60D by means of a linear actuator (not shown) . The first jaw 64D is electrically driven to open and close to grasp a portion of film. A second jaw 66D is secured to the film opening arm 60D and is also driven to grasp film, but is fixed to the film opening arm 60D as opposed to the first jaw 64D.

As the elements of the dispensing apparatus 11 and of the stretching apparatus 12 and the relative movements thereof have been described, the wrapping method will now be explained in detail.

The bundle B1 is upstream of the automated wrapping apparatus 10 and is conveyed towards it by motorized conveyor M. The length of the bundle B1 may be measured with sensors (not shown) or all bundles may be of a generally standard length. In any event, the puling arm 24 is actuated to translate towards the sealing and cutting device 22, and uses its gripping member to grasp a free end of a roll of film 23.

The roll of film 23 is pre-folded in accordance with the desired type of package wrapping required, as explained above. For instance, assuming the film 23 shown in FIG. 2A is used, the free sealed end of film 23 is grasped by the pulling arm 24, and then pulled in the positive Y-axis direction, until a determined length of film 23 is obtained. Thereafter, the sealing and cutting device 22 will seal the pulled film, thereby forming a sealing seam. The sealed seam will be cut in two by the sealing and cutting device 22, such that a bag (using samples of FIGS. 2A to 2D) or a tube (using sample of FIG. 2E or 2F) is formed, and the free end of the roll of film 23 is sealed.

As best seen in FIG. 3, the bag is in a folded and flat state and is positioned on the table 20 such as to project over the edge 26 thereof. The film opening arms 60A and 60D are generally vertical, whereby the first jaws 64A and 64D are face to face with the top portion 3 of the bag, which projects over the bottom portion 4. The first jaws 64A and 64D are located at opposed ends of the flat bag, yet at a distance from the sealing seams thereof. For instance, the distance may be slightly less than half the width of the bundle B1. The first jaws 64A and 64D are actuated to grasp the top portion 3 of the bag. The grasping is facilitated by the fact that the top portion 3 projects over an edge of the bottom portion 4. Accordingly, all types of films, as shown in FIGS. 2A to 2F, have a top portion 3 overlapping over the bottom portion 4.

Thereafter, the first jaws 64A and 64D will translate up by about an inch on the film opening arms 60A and 60D, respectively. The bottom portion 4 of the bag will then be accessible by the second jaws 66A and 66D, which will in turn be actuated to grasp the bottom portion 4. Once the top and bottom portions of the bag are secured in the jaws, the first jaws 64A and 64D will move up the film opening arms 60A and 60D, respectively, to the position shown in FIG. 1, thereby opening the bag. The bag will thus define a rectangular shape opening.

Thereafter, the film opening arms 60A and 60D will be pivoted to reach a generally horizontal position. FIG. 4 depicts the film opening arms 60A and 60D which have almost reached the horizontal positioning. The film opening arms 60A and 60D pivot in a relatively abrupt way, such that the bag 25 thereon gets inflated or displaced by the ambient air.

When the film opening arms 60A and 60D are horizontal, the opened bag will be resting against the rear surfaces 56A to 56D of the brackets 51A to 51D. The winders 52A to 52D are pivoted, whereby the bag will be squeezed between the friction wheels 54A to 54D and the bearing surfaces 55A to 55D, respectively.

Referring to FIG. 3, the friction wheels 54 will be rotated in the direction of arrows E. Thus, the bag will be pulled downward until the gusset 1 of the bag is unfolded (sample of FIG. 2A) and abuts the top edges of the brackets 51A to 51D. The lateral walls of the bag will be accumulated against the rear surfaces 56A to 56D of the brackets 51A to 51D, respectively, and will be randomly folded. When a tube is folded on the film handling assemblies 50A to 50D, a portion will be left unfolded, such as to form a throat portion to be caught on the bundle during the wrapping thereof. For instance, about 4 inch (10 cm) can be left unfolded.

The film handling assemblies 50B, 50C and 50D will then move in the X-axis and Y-axis direction accordingly, as explained above, to stretch the bag. The X-axis and Y-axis movement of the film handling assemblies 50B, 50C and/or 50D will be stopped when the top of the bag has been stretched to be of greater dimension than the top surface of the bundle B1. Typically, a bag or tube is 6% to 15% shorter than the bundle to be wrapped and thus will be stretched by about 15% to 40% to be put on the bundle.

Thereafter, the moveable frame 40 will move downward in the Z-axis direction. Consequently, the top of the bag 25 will abut the top surface of the bundle B1. As the moveable frame 40 moves downward, the lateral walls of the bag, which are folded at a base of the brackets 51A to 51D, will be released gradually and will resiliently move against the lateral surfaces of the bundle B1 to form a tight bond therewith. Referring to FIG. 5, the moveable frame 40 is shown moving downward on the lateral surfaces.

The moveable frame 40 is enabled to move further downward and below the rollers of the conveyor M, such that the bag will be completely released from the film handling assemblies 50A to 50D and will completely wrap five surfaces of the bundle B1. At this point, the bundle may either be moved outward from the automated wrapping apparatus 10 in the positive Y-axis direction, or the moveable frame 40 may be moved back to its initial position adjacent the table 20, and this will be followed by the outward movement of the bundle B1. It is noted that if films depicted by FIGS. 2E and 2F were used, the four lateral surfaces of the bundle B1 would be wrapped while the top and bottom surfaces would be generally uncovered. The bundle B2 may then be displaced below the automated wrapping apparatus 10 to be wrapped according to the above described method. An advantage of the automated wrapping apparatus resides in the fact that a second tube or bag may be prepared on the table 20 as soon as a first bag is disposed on the moveable frame 40. Consequently, precious process time is saved by overlapping these steps.

It is readily understood that the actuated members of the automated wrapping apparatus 10, for instance sensors, linear actuators, hydraulic cylinders, are all connected to a central processing unit if required, such as a computer. Consequently, the actuated members are sequentially actuated for the optimal operation of the automated wrapping apparatus 10. Also, the specifications of the bundles to be wrapped may be programmed in the central processing unit or may be determined on site by sensors and the like.

The automated wrapping apparatus 10 may serve various uses. Bundles of varying size and loaded pallets may be wrapped thereon as the resiliency of the bag or tube ensures the tight and embracing covering and packaging thereof.

It is within the ambit of the present invention to cover any obvious modifications of the embodiments described herein, provided such modifications fall within the scope of the appended claims.

The invention claimed is:

1. A method for automated wrapping of a bundle with a resilient stretchable film, comprising the steps of:

i) unrolling a desired length of said film from a roll, said film having a first panel over a second panel, said panels being interconnected at a sealed first end and at a fold line;

ii) sealing a second end of said panels to bond them together by a second seal at said desired length;

iii) cutting said film along said second seal to form a bag;

iv) separating said first panel of said bag from said second panel by grasping a portion of each said panel of said bag, whereby said bag may be opened at an end opposite said fold line;

v) loading said bag in an opened position on four film handling assemblies of a stretching apparatus;

vi) stretching said bag by expanding said stretching apparatus by displacing at least two of the film handling assemblies; and vii) covering the bundle with said bag, by displacing the stretching apparatus towards the bundle, whereby said stretched bag is gradually released from said film handling assemblies onto said bundle in a stretched resilient condition.

2. The method according to claim 1, wherein the steps iv) to vii) are performed with a first bag while the steps i) to iii) are performed simultaneously with a second bag vii) to wrap a subsequent bundle.

3. The method according to claim 1, wherein in subsequent steps vi) for a first bag and a second bag, the bags are respectively stretched to different levels as a function of different sizes of bundles.

4. The method according to claim 1, wherein bags of different sizes are formed in subsequent sets of the steps i) to iii) as a function of different sizes of bundles.

* * * * *